217-31 SR
10/22/85 XR 4,548,350

United States Patent [19]
Engle et al.

[11] Patent Number: 4,548,350
[45] Date of Patent: Oct. 22, 1985

[54] INTERLOCK ON COLLAPSIBLE CROSS PARTITIONS

[75] Inventors: Donald W. Engle, North Prairie; Roger S. Hahn, Germantown, both of Wis.

[73] Assignee: Rock-Tenn Company, Norcross, Ga.

[21] Appl. No.: 610,701

[22] Filed: May 16, 1984

[51] Int. Cl.[4] ..... B65D 5/48
[52] U.S. Cl. ..... 229/15; 217/31; 229/42
[58] Field of Search ..... 229/15, 28 R, 29 R, 229/29 E, 42, 27; 217/22, 31, 32

[56] References Cited

U.S. PATENT DOCUMENTS

| | | | |
|---|---|---|---|
| 324,999 | 8/1885 | Jaeger | 217/32 |
| 456,353 | 7/1891 | Bower | 217/32 |
| 533,331 | 1/1895 | Williams | 217/32 |
| 606,913 | 7/1898 | Bower | 217/32 |
| 1,975,106 | 10/1934 | Klefeker | 217/32 X |
| 2,024,821 | 12/1935 | Hirshon | 217/31 |
| 2,677,491 | 5/1954 | Burger | 229/28 R |
| 4,103,818 | 8/1978 | Raubenheimer | 229/15 |

*Primary Examiner*—William Price
*Assistant Examiner*—Gary E. Elkins
*Attorney, Agent, or Firm*—Rogers, Howell, Renner, Moore & Haferkamp

[57] ABSTRACT

A carton divider of the type having interlocked partitions of identical construction, each of which has a slot extending inwardly from one edge at an angle thereto and curving back to provide a tab projecting laterally from a hinging line, and a second opening spacer beyond the slot to receive the tab of the companion partition, both openings affording aligned spaced hinging edges on the line; the slot also having a third edge inwardly of the tab, spaced out of alignment with the two hinging edges, and one end of the tab has a slit extending transversely to the tab, and the second opening also has a slit extending toward the slot parallel to, but spaced from, the hinging edges and the crest of the tab slopes inwardly toward the hinging edge.

10 Claims, 7 Drawing Figures

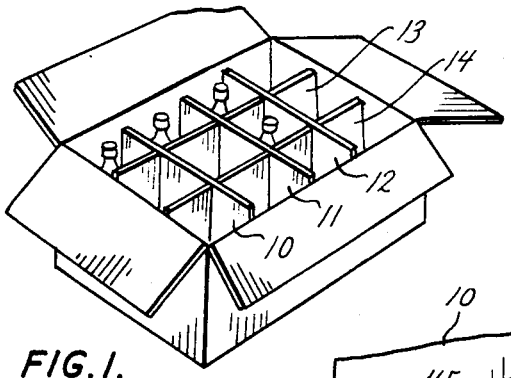
FIG. 1.
FIG. 4.
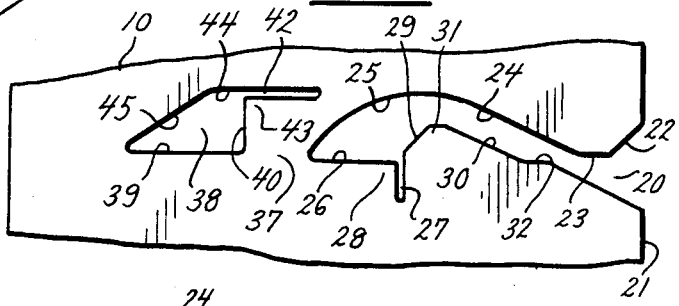
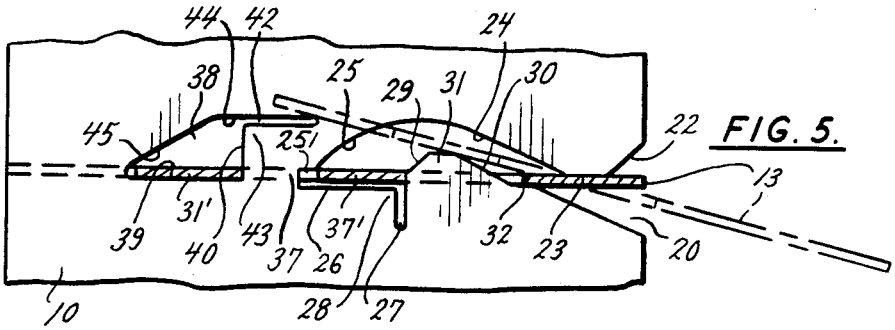
FIG. 5.
FIG. 6.
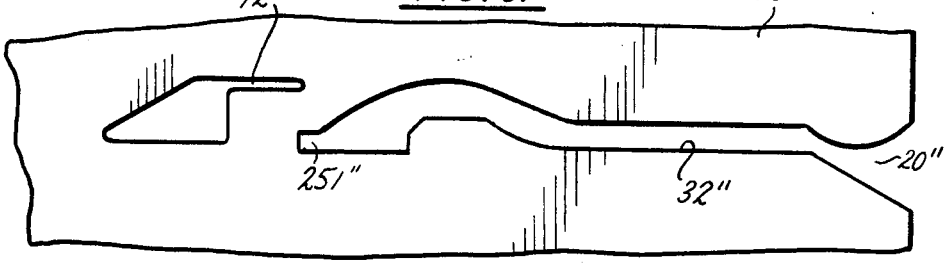
FIG. 7.
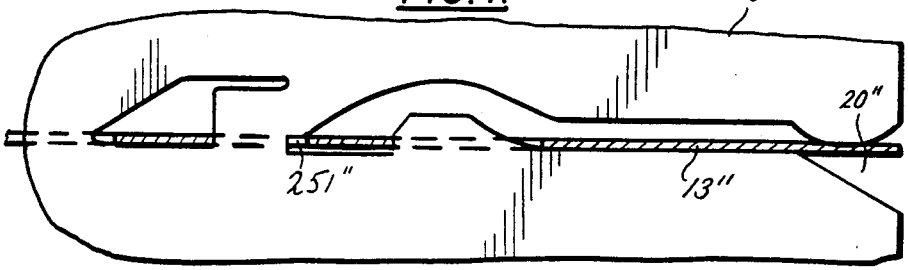

10
11
12
13
14
22'
24'
42
31'
42'
31
20'
23'
45
44
37
25
29
40
25'
43
37'
43'
24
22
20

INTERLOCK ON COLLAPSIBLE CROSS PARTITIONS

BACKGROUND OF THE INVENTION

Tab-type partitions are well-known in the art, as typified by the following patents: Bower U.S. Pat. No. 456,353; Herr U.S. Pat. No. 529,173; Williams U.S. Pat. No. 533,331; Carter U.S. Pat. No. 1,143,036; Lorentzen U.S. Pat. No. 1,442,280; Burger U.S. Pat. No. 2,677,491; and the Raubenheimer U.S. Pat. Nos. 4,358,047 and 4,103,818. All of these patents had the problem of the difficulty of interlocking the partition strips and the bending down or crushing of the tabs as the partitions were interlocked by forcing the tabs across the blank space between the two openings.

It was known, as in the Herr patent and the Carter patent, that slits could be used to aid in engagement of the two partition strips together. However, the types of slits typified by Herr and Carter did not relieve the crushing force as the tabs were forced across the blank space between the openings. And the Raubenheimer patents did not have any such provision. Furthermore, the prior art did not show the present feature of providing spaced aligned hinging edges in each of the two openings, namely, the slot and the second opening, with a third the edge at the inner end of the slot displaced from the hinge line, to reduce the offset caused when the partitions are folded to flat position. Such offset is illustrated in FIG. 5 of the Herr patent. This offset tends to force the partitions apart lengthwise and thereby tends to remove the tabs of one partition strip from the opening of the other when the partitions are in relatively flat interlocked positions, and thereby to unlock them.

It has been found that if the two spaced hinging edges, one in each of the two openings, be maintained but that this intermediate edge at the inner end of the slot be displaced away from alignment with the two edges mentioned, the offset of the partitions as they are in relatively flat positions, is made less abrupt, and the unlocking tendency is reduced.

Thus the objects of the invention are to provide partitions of this type, each having a slot providing a tab, and a second opening, with a slit that makes the tab yieldable, and a slit that makes the blank space that the tab must pass across yieldable, to make engagement of the partition strips easier, and to reduce the crushing effect on the tabs, to make the inner edge of the tabs sloping to increase the distance across the slots which must receive the bridging portions between the slots and the openings. Also an object is to reduce the tendency of the offset of the partitions when in flat position, to separate the partitions, by making the offset less abrupt.

In the drawings:

FIG. 1 is an isometric view of a carton with the partitions in place therein,

FIG. 2 is a fragmentary isometric view of the partitions in their open positions, FIG. 3 is a view of the partitions closed into substantially flat position and interlocked, FIG. 4 is an elevation of the slot portions of one of the partition strips, FIG. 5 is a view of the partition strip of FIG. 4 with a corresponding partition strip being inserted thereinto, FIG. 6 is a view of a somewhat modified form of one of the partition strips, and FIG. 7 is a view similar to FIG. 6 with a corresponding partition interlocked therewith.

DESCRIPTION OF PREFERRED EMBODIMENT

Figures 2, 3:
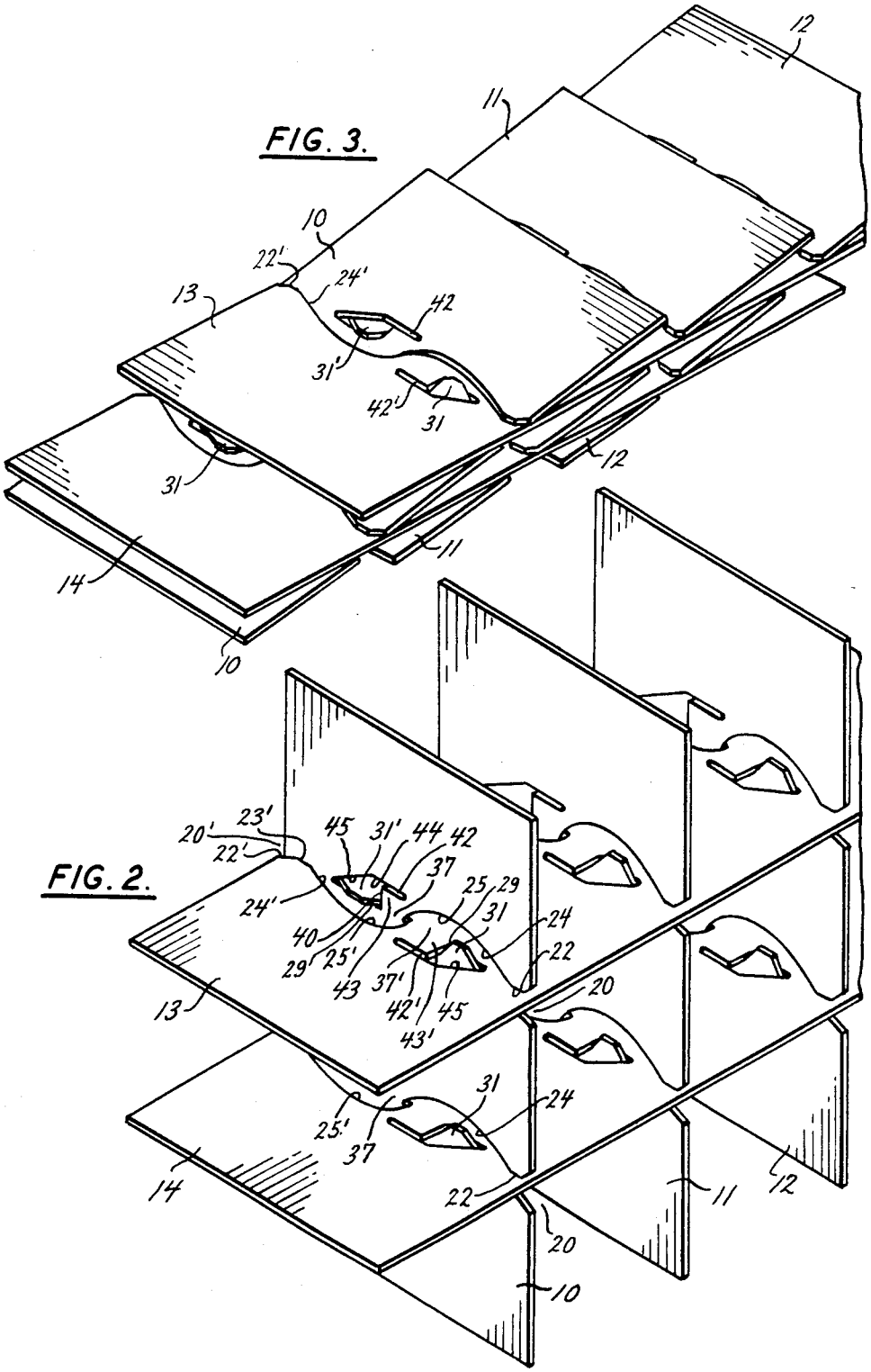

As shown in FIG. 2, where the partition strips are shown vertically in the positions occupied when they are assembled by machine, three (more or less) (so-called) vertical partition strips 10, 11 and 12 have been interlocked with two horizontal partition strips 13 and 14. Needless to say, other numbers of strips could vary with needs.

FIG. 3 shows the partitions in their interlocked flat condition. As will be understood from this art, if the partitions are folded in the opposite direction from that of FIG. 3, they will be readily separable, but in the position of FIG. 2, the tabs are all on the same side and therefore each overlies the edge of the corresponding partition strip and the assembled partitions cannot be separated.

The cuts in the several partition strips are identical. FIGS. 4 and 5 show one of the partition strips, basically partition strip 10. The same partition strip 10 is shown in FIG. 5 with another partition strip such as 13 shown in dashed lines, and also in full lines, to show how they are moved together to be interfitted.

In this type of partition there is a slot 20 cut in from the edge 21 of the partition. The slot has a tapered entrance 22 to enable a corresponding partition strip to be readily inserted. As shown, the slot 20 extends inwardly from the edge 21, forming a projection 23. It then extends upward in a portion 24, and then curves downwardly in an edge portion 25 into a slight notch 251 (FIGS. 5, 6, and 7), and to a horizontal edge 26. The edge 26 extends horizontally a predetermined distance, to a vertical slit 27. The slit 27 and the edge 26 provide a somewhat yieldable, angular lug 28 as will appear. The other edge of the slit 27 continues above the edge 28, to provide a locking edge, and then at a slope 29 and down at 30, forming a tab 31. A short horizontal hinging edge 32 extends to the chamfered entrance 22 of the slot 20. The edge 32 is spaced from the projection 23 by the thickness of the partition strip.

There is an opening 38 spaced as shown from the slot 20 by a section 37 substantially equal to the length of the edge 26. The opening 38 has a hinging edge 39 that is at the same level as the edge 32 of the previous slot, and of a length equal to the length of the base of the tab 31 of that slot. The opening 38 has a vertical locking edge 40 for a purpose to appear. This edge 40 terminates in another narrow horizontal slit 42 extending toward the edge 21 and providing a lug 43 of a right angular nature. The other edge 44 of the slot 42 joins a sloping edge 45 that extends to the edge 39.

In the preferred form, the edge 26 of the slot 20 is displaced to be lower than the edges 32 and 39 by a small amount approximately equal to the thickness of the fiberboard of which the partitions are made, such an an offset of 1/32" (0.28 mm).

FIGS. 6 and 7 show a somewhat modified form of the partitions. Here the partition 10" has a slot 20" just like the previously mentioned slot except that the partition is wider and therefore the edge 32" and a corresponding portion opposite it are considerably longer. Furthermore, in this particular type, the slit 42" is present but the slit 27 has not been used. The other features remain the same and the operation is the same except for the absence of the one slit and its advantages. Each slit has its advantages, but both together are preferred.

It will be understood that if the partition strip 13 is inserted into a partition such as the partition strip 10, the parts will interfit as shown in FIG. 2. In that figure, corresponding parts of the partition strips 13 have been designated by the same numbers, primed, as the numbers of the partition strip 10.

In assembling the partitions by machine, the several partition members (two or more) are initially assembled so that when all are forced together they will occupy the relationship of FIG. 2. In being interfitted, the tab 31' of the entering partition strip rides against the lug 43, of the receiving parition strip, with a tendency to crush the tab. At the same time, the tab 31 of the receiving partition strip rides against the edge of the lug 43' of the entering partition strip. The present invention, however, acts to accommodate such forces because the tabs 31 and 31', by virtue of the slits 27 and 27', and the lugs 28 and 28' by virtue of the slits 42 and 42', can yield laterally to a degree that facilitates the entry of the one partition strip into the other, and reduces the tendency to crush the tabs. The last part of the entire movement finds the edges 25 and 25' engaging to guide the partition strips into their interlocked positions, in which the lug 37' fits into the notch or slot 251, that aids in locking the strips in place. In the modification of FIG. 4, the locking notch is not present.

In the final movement of the partition strips into locked position, the sloping edge 29 of each partition strip provides an enlarged gap across to the other edge 25, that more readily accommodates the blank bridge space 37 across the lug 43 from the edge 25 to the edge 40. This also reduces the damage to the tabs.

When any two criss-crossed partition strips are flattened against each other, as in FIG. 3, the hinge portions must be deformed to enable the parts to lie flat against each other. In the present case, since one of the interlocked partition strips has its slot opening at one edge and the other one has its slot opening in the opposite edge, these two slotted edges can be displaced freely. However, at the middle of the hinge joint, the two spaces 37 and 37' must simply be distorted in order to effect the flat arrangement. The displacement of the hinging portions as noted in the offset manner produces forces tending to separate the two partition strips lengthwise, or in the drawings vertically. This means that the tabs may be forced apart and lose their locking status.

This distortion can be relieved to a significant degree by extending the offset parts of the two partitions laterally beyond the axis of hinging, an action which by extending the offset parts, reduces the abruptness of the offset. In the present design, that additional space cannot be well provided above the edge 26 because the downward slope of the edge 25 to the edge 26 must continue until the two partitions are completely seated together. However, in the present design, the edge 26 has been displaced downwardly away from the line of the two edges 32 and 39 to afford the additional area in which the offset can occur. This furthermore appears to be aided by the presence of the movable or displaceable lugs 28 and 43 which afford a greater yielding in this area. In such arrangement, the hinge line is maintained by the two spaced edges 32 and 39 that should be far enough apart to hold the partitions against twisting when flat. So the displacement of the edge 26 does not offset this stability. Hence, the tendency to force the partitions apart and destroy the locking effect of the tabs is improved by the presence of the offset edges.

These three features act together to improve the operation and quality of the partitions.

There are various changes and modifications which may be made to applicant's invention as would be apparent to those skilled in the art. However, any of these changes or modifications are included in the teaching of applicant's disclosure and he intends that his invention be limited only by the scope of the claims as appended hereto.

We claim:

1. In a partition strip of the kind described adapted to interengage with a corresponding partition strip to make a divider for cartons and the like; means providing a hinge line on the partition strip including a slot extending inwardly from one edge of the partition strip and shaped to provide a tab projecting laterally of the hinge line, the slot terminating short of the opposite edge of the partition strip, an opening spaced from the slot along the hinge line, the opening providing a locking edge and an edge laterally of the hinge line, the opening having a slit spaced from the hinge line and extending toward the initial edge of the partition strip and adapted to provide a yieldable lug portion in the partition strip between the slot and the opening.

2. In the partition strip of claim 1 wherein the slot extends from the first edge of the partition strip laterally around to the inner end of the slot providing a curved edge on one side and the tab on the other side, the tab terminating short of the inner end of the slot and the slot having an edge extending from the inner end of the lug to the inner end of the slot, the said edge being displaced laterally with regard to the hinge line.

3. In the partition strip of claim 1 wherein the tab has a slit adjacent one end thereof extending laterally from the tab to provide greater yieldability of the tab outside of the plane of the partition.

4. In the partition strip of claim 1 wherein the slot has a curved edge opposite the tab extending laterally of the hinge line and around and back to approximately the hinge line at the inner end of the slot, the tab projecting from the opposite side of the slot across the hinge line, the inner end of the tab being spaced from the opposite edge of the slot by approximately the distance from the inner end of the slot to the transverse edge of the opening.

5. In the partition strip of claim 4, the tab extending laterally across the hinge line and back to approximately the hinge line, the portion extending back being sloped inwardly to increase the distance between the tab and the opposite edge of the slot.

6. A partition as in claim 5 together with a second partition of like design interengaged therewith aong the hinge line and with its tab projecting through the opening, and it having an opening through which the first named partition tab extends.

7. In a partition strip of the kind described adapted to mesh with another partition strip to provide a divider for cartons and the like: the partition strip having an edge, a slot having a first entrance through said edge, one side of the slot having its edge extending inwardly to provide a hinging edge, and laterally and then back to provide a tab extending laterally of the partition strip and the hinging edge, the slot extending from the inner edge of said tab further inwardly to terminate within the partition strip and spaced from the opposite edge thereof, the slot then extending laterally from said innermost point to provide a locking notch, and then around said tab and spaced therefrom to said slot entrance, the partition strip having a slit adjacent the tab extending laterally to give the tab greater bending area, an opening spaced inwardly from the innermost end of the slot, the opening having an edge extending inwardly of the partition strip in alignment with the hinging edge of the slot, the opening also having an edge portion extending transversely of the aforesaid edge for locking purposes, the opening also having a slit spaced from the aforesaid hinging edge extending toward the first named edge of the partition strip and providing a yieldable angular lug between the opening and the slot, the innermost edge of the slot that extends inwardly being displaced laterally from the said hinge line of the opening, the space between the transverse edge of the opening and the innermost end of the slot being substantially equal to the length of the inwardly extending inner end of the slot, the inner edge of the tab being curved laterally and inwardly to provide an increased span across from it to the opposite edge of the slot.

8. In a partition strip of the kind described, means providing a hinge line for the partition strip for interengagement with another partition strip of like design, the said means including a slot extending inwardly from one edge of the partition strip, the slot having one of its edges extending laterally of the hinge line and back to approximately the hinge line, the other edge of the slot having a tab projecting across the hinge line and then back to an edge that extends from the inner end of the tab to the inner end of the slot, and a slot extending laterally away from the hinge line at the inner base of the tab whereby the tab is yieldable laterally over a greater distance.

9. In a partition strip of the kind described adapted to be interconected with another partition strip of like design, the partition strip having means providing a hinge line including a slot extending inwardly from one edge of the partition strip and terminating short of the other edge, the slot having one edge that extends laterally of the hinge line around and back to approximately the hinge line at its inner end, the other edge of the slot extending laterally across the hinge line and back to approximately the hinge line to form a tab that extends across the hinge line, the inner edge of the tab from its crest toward but short of the hinge line sloping laterally and inwardly with respect to the hinge line, to increase the distance across from the said edge of the tab to the opposite edge of the slot, the said inner edge of the tab beyond the sloping portion being substantially at right angles to the hinge line to provide a locking edge.

10. In a partition strip of the kind described, adapted to be interengaged with another partition strip of like design, means providing a hinge line for the partition strip including a slot extending inwardly from one edge of the partition strip and the slot having one of its edges extending laterally around and back to approximately the hinge line and its other edge extending inwardly with a portion along the hinge line and then extending laterally across the hinge line and back to approximately the hinge line to form a tab, and the tab having its inner end joined to the inner end of the slot by an edge that is displaced laterally from the hinge line, an opening spaced inwardly from the slot and having a hinging edge along the hinge line and another edge portion extending laterally with respect to the hinge line to form a locking edge, the last-named locking edge being spaced from the end of the slot by a distance approximately equal to the space between the end of the slot and the inner end of the tab.

* * * * *